US006793465B2

(12) United States Patent
Stallings

(10) Patent No.: US 6,793,465 B2
(45) Date of Patent: Sep. 21, 2004

(54) AIR TREATMENT ENCLOSURE

(76) Inventor: William A. Stallings, 5033 Upper Valley Rd., Atglen, PA (US) 19310

( * ) Notice: Subject to any disclaimer, the term of this patent is extended or adjusted under 35 U.S.C. 154(b) by 75 days.

(21) Appl. No.: 10/231,949

(22) Filed: Aug. 30, 2002

(65) Prior Publication Data

US 2004/0042905 A1 Mar. 4, 2004

(51) Int. Cl.[7] ..... F04B 39/06
(52) U.S. Cl. ..... 417/312; 417/313; 417/366; 417/368
(58) Field of Search ..... 417/312, 313, 417/366, 368

(56) References Cited

U.S. PATENT DOCUMENTS 3,856,439 A * 12/1974 Moehrbach ..... 417/312
4,022,550 A * 5/1977 Brink et al. ..... 417/313
4,264,282 A * 4/1981 Crago ..... 417/312
4,311,439 A * 1/1982 Stofen ..... 417/313
5,613,843 A * 3/1997 Tsuru et al. ..... 417/313
5,672,052 A * 9/1997 Ishida et al. ..... 417/312
6,210,132 B1 * 4/2001 Shiinoki et al. ..... 417/368
6,447,264 B1 * 9/2002 Lucas et al. ..... 417/313

* cited by examiner

*Primary Examiner*—Cheryl J. Tyler

(57) ABSTRACT

An air treatment enclosure includes a housing having a fresh air inlet. A baffle is located at the inlet to cause the air to take a flow path having a 90° turn. The air also takes a 90° turn when flowing through an L-shaped plenum in the housing. The side walls and top wall and bottom wall are detachably connected together. A base manifold is located below the bottom wall.

34 Claims, 5 Drawing Sheets

10

64
62
90
60
94
36
44
106
98
108
42
92
104
100
102
22
58
52
96
46
56
58
54

AIR TREATMENT ENCLOSURE

BACKGROUND OF THE INVENTION

Various industries have a need for an air treatment enclosure such as an enclosure which has a compressor for compressing air or other gases. Uses of such enclosures could include, for example, waste treatment assemblies wherein the bubbling of oxygen would increase the sewage capacity. Other uses include aquaculture where the bubbling oxygen is directed to a fish pond catch to increase the number of fish or shrimp. Other uses would include various industrial uses and in the production of medical oxygen.

Frequently the components in such enclosures are quite noisy in operation. In addition, a relatively great amount of heat may be generated which could cause dangerous conditions where proper care is not taken. Such enclosures also may operate with varying degrees of efficiency.

SUMMARY OF THE INVENTION

An object of this invention is to provide an air treatment enclosure wherein the components within the enclosure operate in a simple and effective manner.

A further object of this invention is to provide such an enclosure which minimizes noise and heat.

In accordance with this invention the air treatment enclosure comprises a housing having side walls, a bottom wall and a top wall. The housing includes a fresh air inlet. Within the housing is a positive displacement blower and an air flow unit such as a valve. A base manifold connects the valve to the blower. An air treatment assembly which preferably includes a heat exchanger and its related piping is in flow communication with the blower to treat the air, such as by the blower compressing the air. The air treatment assembly is also in flow communication with the air flow unit or valve. An outlet passage is connected to the air flow unit and extends externally of the housing. Fresh air would flow into the housing and into the air flow unit, then through the base manifold and then into the blower. The air would then be treated by the air treatment assembly and the treated air would flow back into the air flow unit to be discharged to a location external of the housing in accordance with the desired end use of the treated air or other gas.

In a preferred practice of the invention the air flow unit or valve has a nipple extending below the bottom wall of the housing. Similarly, the positive displacement blower has a nipple extending below the bottom wall. The base manifold is also located below the bottom wall to create communication between the valve and the blower. As a result the base manifold also functions as an acoustic chamber which permits the elimination of a special silencer that might otherwise be desired or required.

The housing also preferably includes a fan for drawing in the fresh air and for cooling the blower. Preferably the fan and blower are connected by a belt drive so that both may be driven by a single motor. The fan preferably directs fresh air into an L-shaped plenum. The heat exchanger may be mounted in one leg of the L-shaped plenum so that the air flowing through the plenum would function to cool the heat exchanger. Air from the plenum could then be discharged to the atmosphere.

In a preferred practice of the invention the various walls are detachably connected together so as to create a number of individual subassemblies. One such subassembly would include the two adjacent walls having the L-shaped plenum and the heat exchanger, as well as the bottom wall which would contain most of the components. Alternately each of the four side walls and the top wall and the bottom wall could be a separate subassembly. The outer walls of the L-shaped plenum could be separated into separate sections which form the L-shape when their walls are secured together. Thus, when the remaining walls are detached there is ready access to the interior of the housing.

THE DRAWINGS

DETAILED DESCRIPTION

Figures 1, 2, 3:
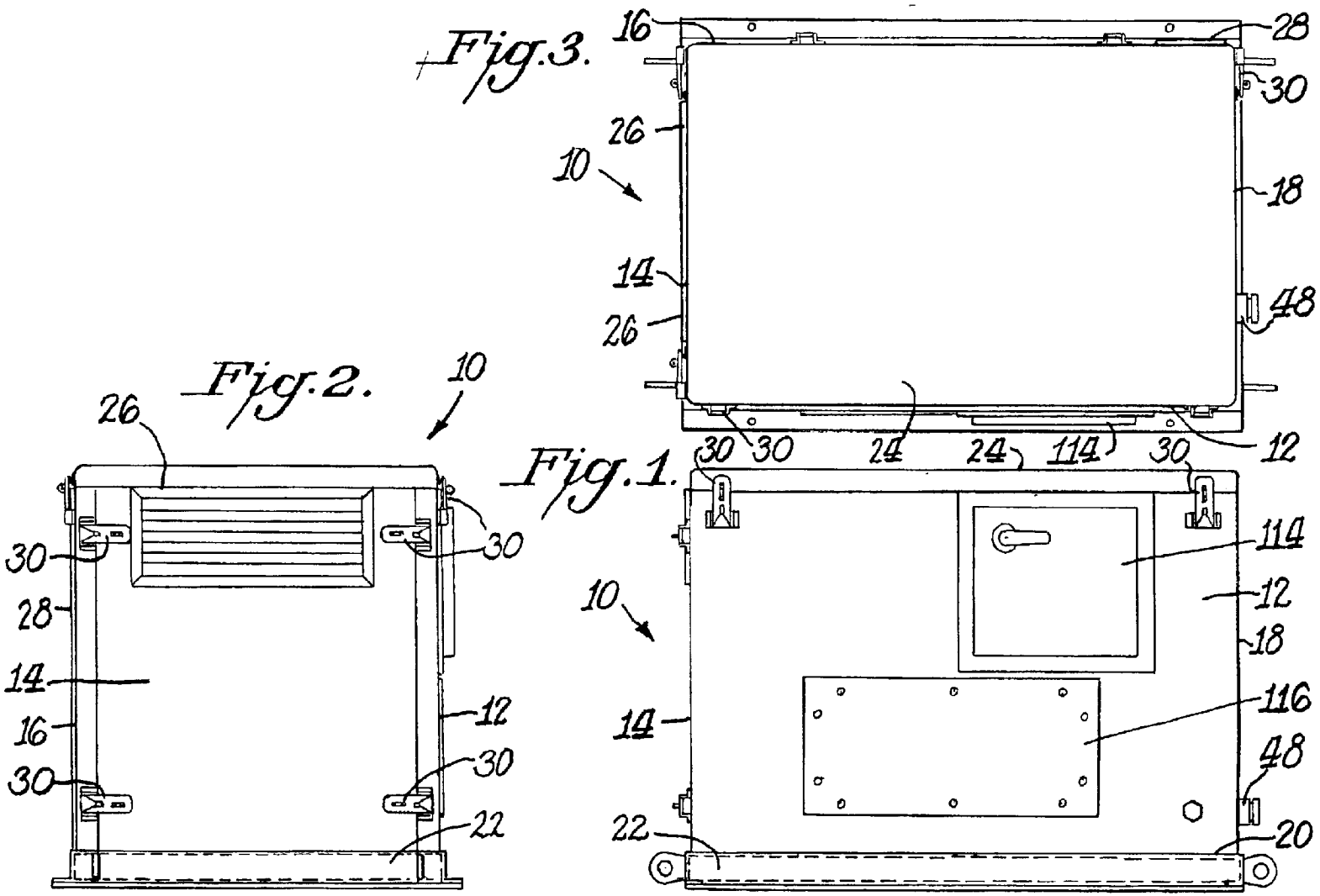
FIG. 1 is a front elevational view of an air treatment enclosure in accordance with this invention.
FIG. 2 is a left side elevational view of the enclosure shown in FIG. 1.
FIG. 3 is a top plan view of the enclosure shown in FIGS. 1–2.

FIGS. 1–5 illustrate an enclosure 10 in accordance with this invention when viewed from the outside. The enclosure 10 includes a plurality of side walls 12,14,16,18 which are joined together to form a closed periphery housing. A bottom wall 20 is located at the lower end of the periphery with a lower base 22 extending below the bottom wall 20. A top wall 24 covers the enclosed periphery housing.

As shown in FIG. 2 wall 14 includes an air inlet 26 in the form of a louver. Adjacent wall 16 may optionally include a vertical louver 28 (FIG. 4) to permit air to flow out of the enclosure 10 as later described. The various adjacent walls are latched together by any suitable latch structure 30 for purposes later described.

Figure 6:
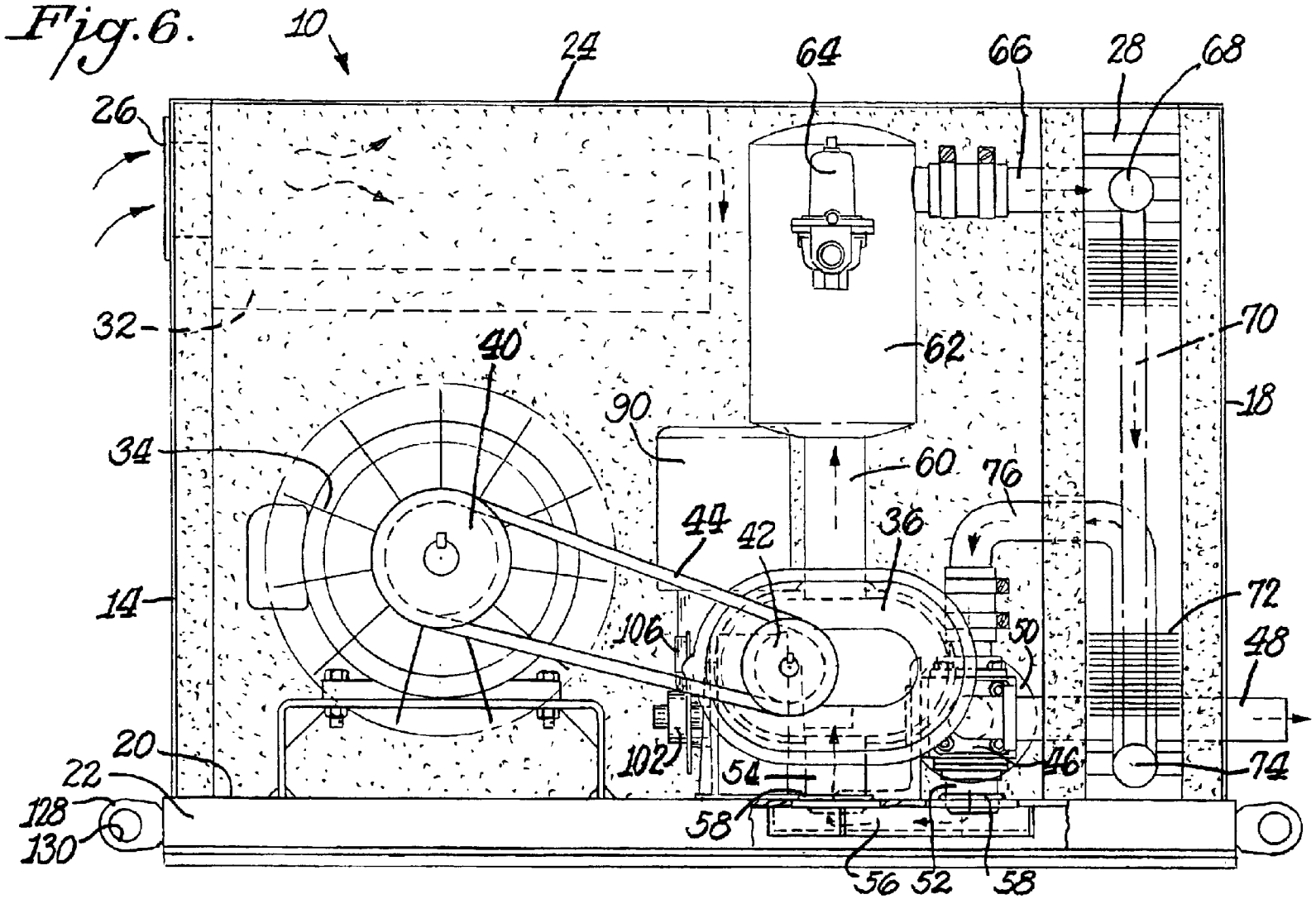
FIG. 6 is a front elevational view of the enclosure shown in FIGS. 1–5 with one of the side walls removed to show the interior components of the enclosure.
Figure 7:
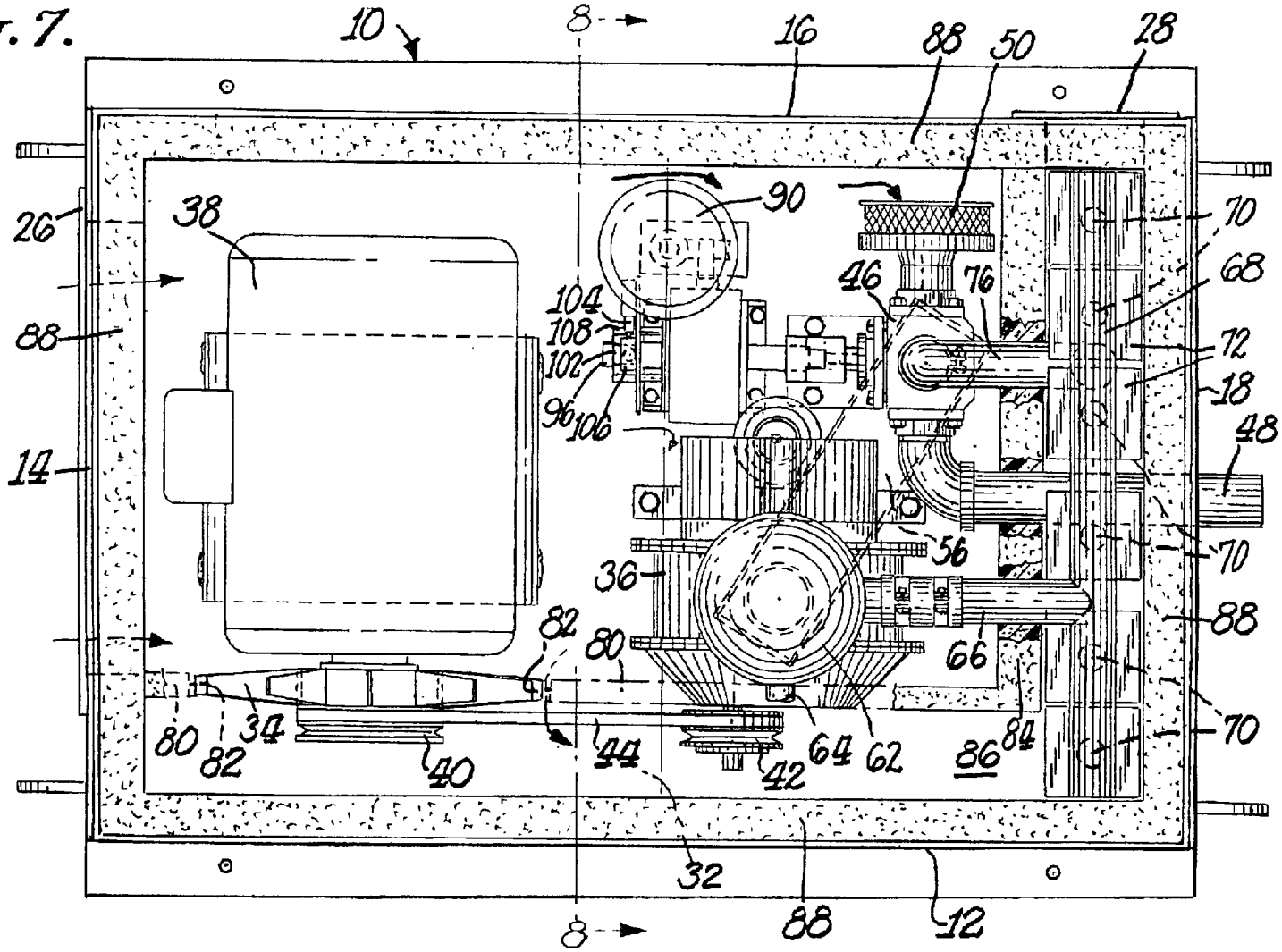
FIG. 7 is a top plan view of the housing shown in FIG. 6 with the top cover removed to show the internal components.

As shown in FIGS. 6–7 fresh air enters enclosure 10 through inlet 26 in wall 14. As best shown in FIG. 6 a baffle 32 made from a composite or foam material is located below inlet 26 to direct the flow of air toward the center of the interior of the housing or enclosure 10 to create a chamber for guiding the incoming air flow. A fan 34 is located in housing 10 as well as a blower 36. Blower 36 is preferably a known positive displacement rotary lobe blower which could be of any suitable construction. Reference is made to U.S. Pat. Nos. 5,957,664 and 5,702,240, all of the details of which are incorporated herein be reference thereto.

Fan 34 is driven by motor 38 as shown in FIG. 7. Fan 34 and blower 36 are each provided with a suitable pulley 40,42. Belts 44 are mounted over pulleys 40,42 so that the same motor 38 drives both the fan 34 and the blower 36.

Fan 34 functions to cool blower 36 and also to assist in drawing fresh air into the interior of housing 10.

As shown in FIG. 7 some of the fresh air flows across the interior of housing 10 and into an air flow unit 46. Air flow unit 46 functions to alternately permit the air to flow into blower 36 and also to be discharged through discharge pipe 48 to a location external of enclosure 10. Thus, as shown in FIGS. 1, 3, 6 and 7 discharge pipe 48 extends outwardly of wall 18. If desired, air flow unit may be capable of alternately functioning in a suction manner and in a positive air pressure manner. In the preferred practice of this invention the air flow unit 46 is a valve having a filter 50 located at its air entrance end. The air thus flows through filter 50 into valve 46 as shown in FIG. 7.

FIG. 6 shows the valve 46 to have a nipple 52 which extends into the lower base 22. Similarly, blower 36 has a nipple 54 which extends into the lower base. A significant feature of this invention is the provision of a hidden base manifold 56 which is connected to nipples 52 and 54 so that the flow of air from valve 46 can continue through base manifold 56 and then enter blower 36 through nipple 54. Preferably sealing structure such as o-ring seals 58,58 assure a gas tight connection between base manifold 56 and nipples 52 and 54.

The provision of the hidden base manifold 56 provides the advantages of exceptional simplicity in creating communication between valve 46 and blower 36 in an extremely compact design. The base manifold 56 also eliminates the need for multiple plumbing connections since only two connections at nipples 52 and 54 are required. This also permits very simple installation and removal. In addition, by being located in the lower base 22, base manifold 56 functions as an acoustic chamber eliminating the need for a special suction silencer in that general location. The positioning of the suction porting for the inlet filter or inlet pipping is optimal without the need for additional fittings.

As best shown in FIG. 6 the air flowing from blower 36 passes through pipe 60 and then into discharge silencer 62. Discharge silencer 62 may be provided with a regulator 64 to adjust the air flow. The air then passes into upper delivery pipe 66 and into heat exchanger header 68.

FIG. 6, shows the enclosure for this invention wherein a header 68 includes a plurality of vertical feed exchange tubes 70 each of which is provided with a plurality of fins 72 extending the entire length of tubes 70 (although not all of the fins are illustrated). The air exits from tubes 70 into lower manifold 74 and then travels through delivery pipe 76 back into valve 46. The manifold and heat exchangers may be considered part of an air treatment assembly which results in the air being compressed such as in a range of 5–18 psi. The treated or compressed air would be discharged from valve 46 through outlet pipe 48 as later described. The enclosure may be used with other forms of heat exchangers.

In accordance with a further feature of this invention structure is provided to keep the housing cool. As shown in FIG. 7 an inner wall 80 is provided at fan 34 and extends the full height of housing 10 from the bottom wall 20 to the top wall 24. Wall 80 has sufficient open area to accommodate fan 34 and permit the air to flow through the open spaces 82 as shown by the arrow in FIG. 7. Wall 80 is joined to a perpendicular vertical wall 84 to create an L-shaped plenum 86 between walls 80 and 84 and spaced walls 12 and 18. Thus, outer side wall 12 is parallel to wall 80 to form one leg of L, while outer side wall 18 is parallel to wall 84 to form the other leg. Various outer side walls are preferably lined with an acoustic material such as foam 88. The heat exchanger tubes 70 are located in the portion of the L-shaped plenum 86 created between wall 84 and the padding 88 of outer side wall 18. By making walls 80 and 84 also of acoustic material such as foam, there is further noise damping.

The air flowing through openings 82 into the L-shaped plenum 86 pass along the heat exchanger and exit through vertical louver 28 into the atmosphere. As a result of the flowing air in plenum 86, the heat exchanger is cooled.

Figure 8:
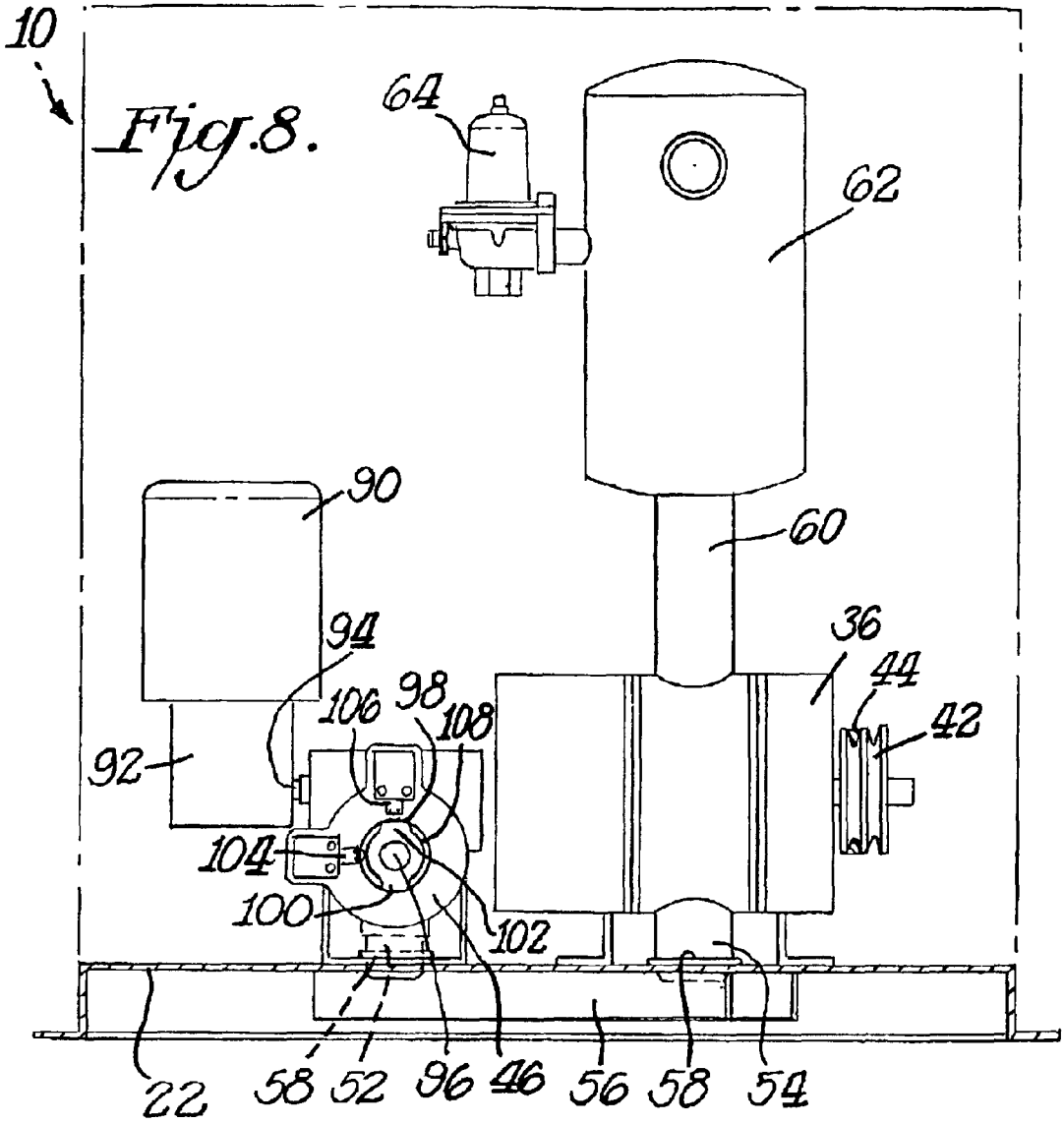
FIG. 8 is a cross-sectional view taken through FIG. 7 along the line 8—8.

FIGS. 6–8 best illustrate the operation of blower 36 to cause valve 46 to alternately be in a suction mode and in a positive air pressure mode. Although a proximal switch may be used, FIGS. 6–8 illustrate an alternative arrangement. As shown therein the operation of valve 46 is controlled by motor 90 through associated gearing in gear box 92. The motor 90 drives a shaft 94 connected to valve 46. Motor 90 also drives a second shaft 96. A cam 98 is mounted on shaft 96. Cam 98 has two lobes 100,102 located 180° apart. Two limit switches 104,106 are located 90° apart. As cam 98 rotates the lobes 100,102 contact the respective limit switches 104,106. Continued rotation of the cam results in the dwell surfaces 108 being disposed toward the limit switches. Each limit switch 104,106 is attached to a timer in an electrical control system to control the vacuum mode of valve 46 and to control the positive pressure mode of valve 46. For example, the vacuum mode may take place for 27 seconds followed by 17 seconds of positive pressure mode. These ranges could be adjusted in accordance with the desired operation. The operation of valve 46 might thus be considered similar to the operation of lungs in a human where there is an alternating inhaling and exhaling.

Figure 9:
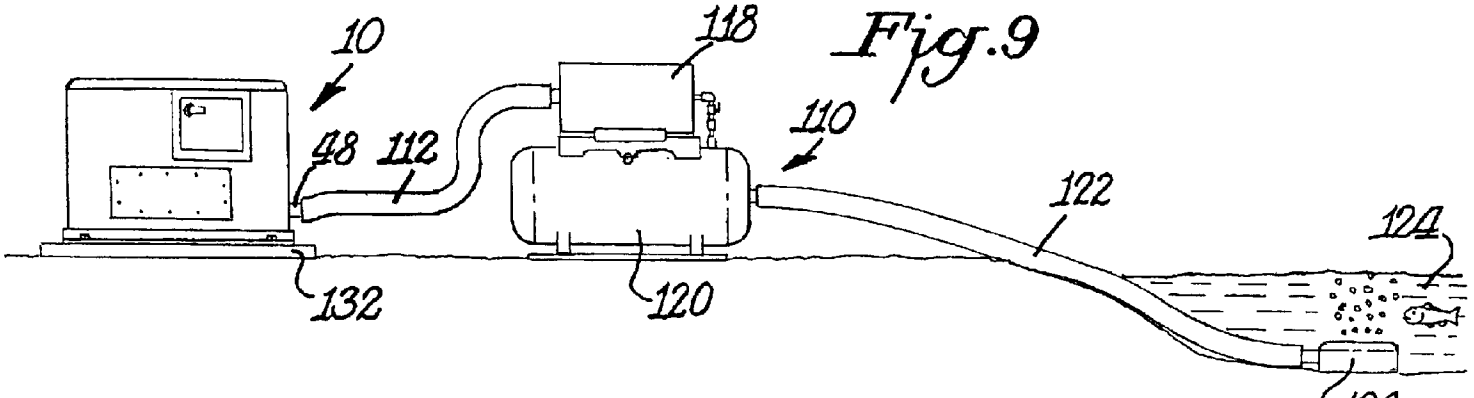
FIG. 9 is a schematic view showing the enclosure of FIGS. 1–8 as used for aquaculture.
Figure 4:
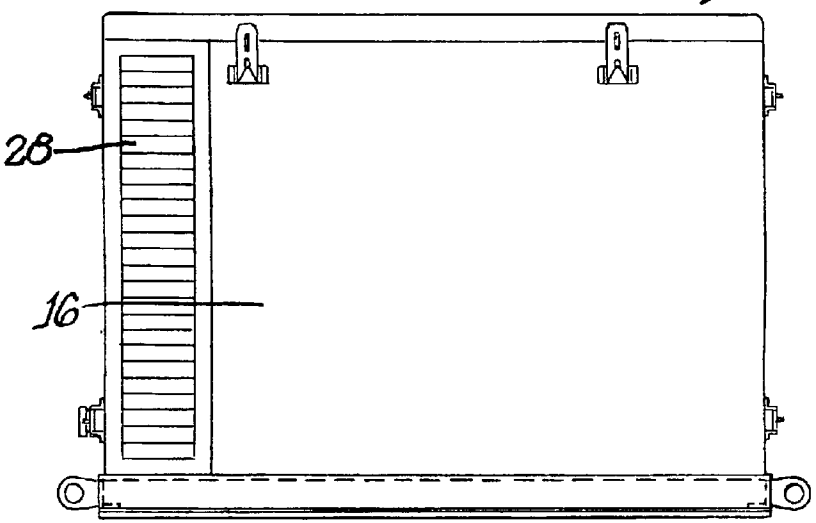
FIG. 4 is a rear elevational view of the enclosure shown in FIGS. 1–3.
Figure 5:
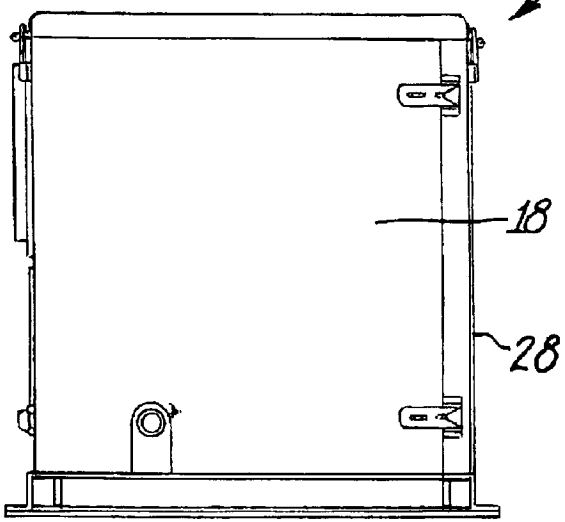
FIG. 5 is a right side elevational view of the enclosure shown in FIGS. 1–4.

When associated with an oxygen generator such as the oxygen generator 110 shown in FIG. 9 which is part of an aquaculture system, the oxygen in the air becomes purified to, for example 90–96% purity. This is facilitated by the utilization of lithium particles in the oxygen generator 110 for removing nitrogen from the air. The lithium particles would become loaded with nitrogen gas. Every 27 seconds valve 46 would be opened and the vacuum would pull the nitrogen gas through an exit pipe and filter to release the gas to the atmosphere. During this purging a small amount of oxygen might also be removed from a check valve in the oxygen generator 110. In every alternate 17 second cycle the pressurized air from outlet pipe 48 would be delivered through tubing 112 to oxygen generator 110.

Enclosure 10 is constructed so as to maximize convenience in installation and maintenance or repair of the components within the enclosure. As shown in various figures, such as FIG. 1 one of the walls, namely wall 12, includes an openable or removable access cover 114 which would be located so as to provide access to the electrical controls for the components within enclosure 10. A removable hatch 116 is also provided on wall 12 to provide access to the belts 44 operating, for example, the fan 34 and blower 36.

A further advantageous feature of the enclosure 10 is the ability to remove selected walls so as to provide access to the components within enclosure 10. Thus, by manipulating latches or fastening mechanisms 30 side wall 12, top wall 16 and side wall 14 could be removed leaving a subassembly which would consist of side walls 16 and 18 and bottom wall 20 as well as lower base 22 along with the various components mounted on bottom wall 20. Because side walls 12 and 14 and top wall 16 are removed, the components within the enclosure 10 are exposed for easy access.

A further feature of the invention is the provision of lower base 22. Lower base 22 is formed by extending at least two of the side walls downwardly beyond lower wall 20. These downward extensions or flanges create an open area below the bottom wall 20. This open area is used for mounting base manifold 56. In addition, further acoustic material could be located in the lower base to further reduce noise.

The flange type lower base 22 thus permits the application of an elastomer gasketing around the entire bottom perimeter to acoustically seal the "drum effect" noise of the base plate vibrations from escaping. The lower base structure could be formed by two flanges located to tuck in on the short walls 14,18. By tucking in the flanges it is not necessary to utilize or cope with the problems of forming the lower base with angle iron structure. This eases manufacturing. Various types of acoustic material could be used and mounted in any suitable manner such as by edge gasketing or by the use of flat gaskets.

FIG. 9 shows one possible end use of enclosure 10. As previously described this end use is in connection with aquaculture. Reference is made to U.S. Pat. No. 4,172,465 and to U.S. Pat. No. 4,783,210, all of the details of which are incorporated herein by reference thereto.

The nitrogen would be removed from the air in compartment 118. The purified oxygen would be stored in compartment 120. When desired oxygen would be fed from compartment 120 through discharge hose 122 into pond 124 by being fed through bubbler 126. This creates conditions more favorable for fish to survive in pond 124.

As illustrated lower base 22 may include extensions 128 having openings 130 which could be utilized for transporting the enclosure 10 by hooking chains, ropes, cables or other structure through the holes or openings 130. Since the placement of the type of enclosure having a compressor on a concrete pad could be extremely noisy, the enclosure 10 could be placed on a skid or other elevated structure 132 (see FIG. 9) to further minimize noise.

In general, the various components housed within enclosure 10 are of known construction and operation. For example, blower 36 is a known positive displacement rotary lobe blower. Such typical blowers may be of the type referred to in U.S. Pat. Nos. 5,702,240 and 5,957,664 the details of which are incorporated herein by reference thereto.

The overall dimensions of enclosure 10 could be 33 inches wide from the bottom wall 20 to the top of the housing or 34 inches wide from the bottom of lower base 22 to the top of the housing. The length of enclosure 10 could be 50 inches long from wall 14 to wall 18 or 51 inches long when measured at the lower base 22. The height from bottom wall 20 to the top of the enclosure could be 35 inches while the height from the bottom of the lower base 22 could be 37.75 inches. The enclosure could rest on 0.50 inches thick rubber pads on all four sides. Other dimensions could be used where a larger or smaller enclosure is desired in accordance with the components to be housed in the enclosures.

Baffle 32 could extend inwardly from wall 14, 24 inches and be located 7.625 inches below the top wall 24. This creates an acoustic chamber into which the fresh air flows. The foam lining against the various walls is preferably 2 inches thick.

The plenum chamber 86 could be formed from wall 80 which could be one inch thick so that the width of the plenum chamber in that portion of the L-shaped chamber could be 4.065 inches. Wall 84 which encloses the heat exchanger could be preferably 2 inches thick with the plenum chamber width being 4.5 inches. Header 68 and lower manifold 74 could be 28.75 inches long while the tubes 70 from the header to the lower manifold could be 27.75 inches long.

Typically, the mechanical and acoustical package resulting from enclosure 10 would be at 5H.P. to 15 H.P. Technically, there is no limit but this range reflects the commercially viable range. The most volume would be in the 10–40H.P. range.

The fresh air ventilation fan 34 provided as part of the main drive motor assembly enables elimination of the entire ventilation air fan assembly motor, motor starter, safety controls and shrouds with guards. In addition, there is direct optimized air flow into the acoustic ventilation air discharge plenum 86. This offers the best possible air flow characteristics without compromise of acoustic performance. The ventilation discharge air plenum 86 is configured to provide excellent air flow and acoustic performance and a viable chamber into which secondary process heat exchangers can be fitted for major enhancement of overall thermal dynamic performance of the blower. For example, the air or gas entering the heat exchanger might typically be at 260°–280° F., but would exit at 130°–150° F.

As noted the latch-together type cabinet or housing provides quick and easy access to all internal operating components. For example, each of the side walls and the top wall and the bottom wall may be detached from each other to maximize selective access to the interior of the housing. The L-shaped plenum could be split at its corner to facilitate manufacture and assembly of enclosure 10.

Not all portions of the housing are necessary. The louvers 28 in wall 16 could be omitted where air discharge is not required. The enclosure could house other forms of heat exchangers. Where a heat exchanger is located at the end of plenum 86 the air discharge louvers 28 could be omitted.

The desirable features of enclosure 10 include the structures which require the air flow to include sharp and preferably right angle turns in the flow path. This results from the baffle 32 at the air inlet and the downstream L-shaped plenum 86. Preferably the single motor is located below the baffle 32. A further advantageous feature is the base manifold 56, particularly the location of the base manifold below the bottom wall in the sub-base area which would otherwise be wasted space. In addition the detachability of each of the six walls from each other make the enclosure especially user friendly. These various features make enclosure 10 suitable with various types of equipment, and not simply the equipment shown and described herein. Depending on the type and size of such equipment, enclosure 10 may be made in various sizes and used with various horsepower components.

What is claimed is:

1. An air treatment enclosure comprising a housing having a set of side walls connected to each other to form a closed periphery, a bottom wall at the lower end of said periphery, a top wall covering said periphery, said housing having a fresh air inlet, a positive displacement blower in said housing, a base manifold located below said bottom wall in flow communication with said blower, an air treatment assembly in flow communication with said blower for treating air flowing from said blower to said air treatment assembly, and an air flow unit in said housing in flow communication with said fresh air inlet of said housing, said air flow unit having a flow connection to said base manifold, a passageway connecting said positive displacement blower and said base manifold, said passageway being connected to said base manifold at a location spaced from said flow connection of said air flow unit to said base manifold whereby a flow path is created between said air flow unit and said positive displacement blower through said base manifold.

2. The enclosure of claim 1 including air flow structure in said housing for directing the air flowing through said housing to take at least one sharp turn.

3. The enclosure of claim 2 including a vertically disposed plenum chamber in said housing.

4. The enclosure of claim 3 wherein said plenum chamber has discharge structure for discharging the flowing air out of said enclosure.

5. The enclosure of claim 3 including a fan communicating with said plenum chamber for drawing air into said plenum chamber and for cooling said blower, a motor operating said fan, and a pulley belt drive connecting said fan to said blower whereby said motor operates both said fan and said blower.

6. The enclosure of claim 3 wherein said vertical plenum chamber is L-shaped, and said air flow structure including said L-shaped plenum chamber.

7. The enclosure of claim 6 including a vertical louver construction located at an end of said L-shaped plenum chamber.

8. The enclosure of claim 7 wherein said side walls comprise four walls, said vertical louver construction being located in one of said walls, said air inlet being a louver in an adjacent wall, and a baffle located within said enclosure below said air inlet louver.

9. The enclosure of claim 8 wherein two of said side walls are detachable from the other two of said side walls, and said top wall being detachable from said side walls whereby a subassembly may result from said other two walls and said bottom wall and components mounted to said bottom wall.

10. The enclosure of claim 8 wherein all of said side walls and said top wall and said bottom wall are detachable from each other, and said L-shaped plenum chamber being separable at the junction of the L-shape.

11. The enclosure of claim 8 wherein one of said walls includes an openable cover plate for providing access to electrical controls within said housing, and said one of said walls further including an openable hatch to provide access to the interior of said housing.

12. The enclosure of claim 3 including acoustic material lining the inner surface of said side walls, the walls of said plenum chamber including acoustic material, acoustic material included in a lower base below said bottom wall, and said base manifold being in said lower base.

13. The enclosure of claim 1 wherein at least two of said walls which are located parallel to each other include flange extensions for creating a lower base, and said base manifold being in said lower base.

14. The enclosure of claim 1 wherein said inlet is located at one said side walls, a baffle located at said one side wall below said inlet, said baffle extending toward the interior of said housing to cause the incoming air to flow over and around said baffle, and said air flow structure including said baffle.

15. The enclosure of claim 14 including a motor under said baffle.

16. The enclosure of claim 14 including a vertically disposed L-shaped plenum chamber in flow communication with said interior of said housing, and said air flow structure including said L-shaped plenum chamber.

17. The enclosure of claim 16 wherein said L-shaped plenum chamber is located at two adjacent of said side walls, and said adjacent side walls being side walls which differ from said one side wall.

18. The enclosure of claim 1 wherein said top wall and said bottom wall are detachably mounted to at least some of said side walls, and at least two of said side walls being separately detachable from the remaining of said side walls.

19. The enclosure of claim 18 wherein two of said side walls are detachable from the other two of said side walls, and said top wall being detachable from said side walls whereby a subassembly may result from said other two walls and said bottom wall and components mounted to said bottom wall.

20. The enclosure of claim 1 wherein said base manifold comprises an acoustic chamber.

21. The enclosure of claim 1 wherein said air treatment assembly is in flow communication with said air flow unit whereby some air passes from said air flow unit to said blower and then to said air treatment assembly and then back to said air flow unit.

22. The enclosure of claim 1 wherein said air flow unit includes a valve.

23. The enclosure of claim 22 wherein said valve has a filter at its air entrance end.

24. The enclosure of claim 22 wherein said valve has a nipple as said flow connection to said base manifold.

25. An air treatment enclosure comprising a housing having a set of side walls connected to each other to form a closed periphery, a bottom wall at the lower end of said periphery, a top wall covering said periphery, said housing having a fresh air inlet, a positive displacement blower in said housing, a base manifold located below said bottom wall in flow communication with said blower, an air treatment assembly in flow communication with said blower for treating air flowing from said blower to said air treatment assembly, air flow structure in said housing for directing the air flowing through said housing to take at least one sharp turn, including a nipple on said blower extending below said bottom wall into a lower base below said bottom wall, said base manifold being mounted in said lower base, and sealing structure connecting said base manifold to said blower nipple.

26. An air treatment enclosure comprising a housing having a set of side walls connected to each other to form a closed periphery, a bottom wall at the lower end of said periphery, a top wall covering said periphery, said housing having a fresh air inlet at one of said side walls, a baffle in said housing at said one side wall below said air inlet, said baffle extending outwardly from said one side wall in a generally horizontal direction toward the interior of said housing, a vertically disposed L-shaped plenum chamber at two other of said side walls, said L-shaped plenum chamber being formed by a pair of connected legs, a heat exchanger being in one of said legs, and said plenum chamber being in air flow communication with said interior of said housing.

27. The enclosure of claim 26 including a lower base below said bottom wall, and a base manifold in said lower base.

28. The enclosure of claim 27 wherein all of said side walls and said top wall and said bottom wall are detachable from each other, and said L-shaped plenum chamber being separable at the junction of the L-shape.

29. The enclosure of claim 28 including acoustic material lining the inner surface of said side walls, and the walls of said plenum chamber including acoustic material.

30. The enclosure of claim 26 including a motor below said baffle.

31. The enclosure of claim 30 wherein there are four side walls, two of said side walls being detachable from the other two of said side walls, and said top wall being detachable from said side walls whereby a subassembly may result from said other two walls and said bottom wall and components mounted to said bottom wall.

32. The enclosure of claim 26 wherein said top wall and said bottom wall are detachably mounted to at least some of said side walls, and at least two of said side walls being separately detachable from the remaining of said side walls.

33. The enclosure of claim 26 wherein one of said walls includes an openable cover plate for providing access to electrical controls within said housing, and said one of said walls further including an openable hatch to provide access to the interior of said housing.

34. The enclosure of claim 26 including acoustic material lining on the inner surface of said side walls, and the walls of said plenum chamber including acoustic material.

* * * * *